US006554635B2

(12) United States Patent
Ayers et al.

(10) Patent No.: US 6,554,635 B2
(45) Date of Patent: Apr. 29, 2003

(54) SYSTEMS FOR COMMUNICATIVELY COUPLING COMPUTING DEVICES

(75) Inventors: Raymond L. Ayers, Meridian, ID (US); Dean Richtsmeier, Boise, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 0 days.

(21) Appl. No.: 09/941,461

(22) Filed: Aug. 29, 2001

(65) Prior Publication Data

US 2003/0045154 A1 Mar. 6, 2003

(51) Int. Cl.[7] ..... H01R 13/627
(52) U.S. Cl. ..... 439/362; 439/374
(58) Field of Search ..... 439/362, 374, 439/680, 378, 365, 353, 638, 76.1

(56) References Cited

U.S. PATENT DOCUMENTS

| | | | | | |
|---|---|---|---|---|---|
| 3,582,867 | A | * | 6/1971 | Thompson | 439/92 |
| 4,398,780 | A | * | 8/1983 | Novotny et al. | 439/49 |
| 4,861,276 | A | | 8/1989 | Muller et al. | |
| 4,934,950 | A | * | 6/1990 | Green et al. | 439/681 |
| 5,092,791 | A | * | 3/1992 | Contarino | 439/365 |
| 5,098,312 | A | * | 3/1992 | Raczyuski | 439/362 |
| 5,234,353 | A | | 8/1993 | Scholz et al. | |
| 5,391,091 | A | * | 2/1995 | Nations | 439/378 |
| 6,007,360 | A | | 12/1999 | Wu et al. | |
| 6,203,333 | B1 | * | 3/2001 | Medina et al. | 439/76.1 |
| 6,273,740 | B1 | * | 8/2001 | Lord | 439/353 |
| 6,301,016 | B1 | * | 10/2001 | Matsueda et al. | 358/407 |
| 6,343,957 | B1 | * | 2/2002 | Kuo et al. | 439/638 |

OTHER PUBLICATIONS

"Connector Cover with Bevelled Surfaces for Visual Alignment". IBM Technical Disclosure Bulletin, IBM Corp., New York, US. vol. 39, No. 3, p. 279.

* cited by examiner

*Primary Examiner*—P. Austin Bradley
*Assistant Examiner*—Phuongchi Nguyen

(57) ABSTRACT

Interface devices for use in a computer system are provided. A representative interface device includes an interface connector and an interface adapter. The interface connector is configured to mate with the connector of a computing device. The interface adapter engages the interface connector and defines a first alignment surface. The first alignment surface is configured to engage a first protrusion of the computing device as the interface connector is moved toward mating engagement with the connector of the computing device. So configured, the interface connector can be aligned with the connector of the computing device prior engagement of the interface connector with the connector of the computing device. Other systems also are provided.

6 Claims, 3 Drawing Sheets

SYSTEMS FOR COMMUNICATIVELY COUPLING COMPUTING DEVICES

BACKGROUND OF THE INVENTION

1. Field of the Invention

The present invention relates to computers. More specifically, the invention relates to systems for communicatively coupling computing devices.

2. Description of the Related Art

Computer systems typically include multiple computing devices that are adapted to communicate with each other to perform discrete tasks. For example, a conventional computer system includes a personal computer and an associated printer. The personal computer and printer typically are communicatively coupled to each other by an interface device, e.g., a printer cable, so that information provided to the printer can be converted into a document.

Interface devices used to interconnect computing devices incorporate connectors on each of their ends. These connectors are configured to engage and mate with corresponding connectors of the computing devices. As is known, the operator of a computing device should exercise care when attempting to mate the connectors of an interface device with corresponding connectors of computing devices. In particular, care should be taken so that components of the various connectors are not damaged. For instance, if the pins of a male connector are not properly aligned with corresponding holes of a female connector and a user attempts to force the connectors into mating engagement with each other, the pin(s) of the male connector and/or hole(s) of the female connector could be damaged.

SUMMARY OF THE INVENTION

Briefly described, the present invention involves communicative coupling of computing devices. In this regard, a representative communication interface device of the invention that is adapted for use in a computer system includes an interface connector and an interface adapter. The interface connector is configured to mate with the connector of a computing device. The interface adapter engages the interface connector and defines a first alignment surface. The first alignment surface is configured to engage a first protrusion of the computing device as the interface connector is moved toward mating engagement with the connector of the computing device. So configured, the interface connector can be aligned with the connector of the computing device prior engagement of the interface connector with the connector of the computing device.

A representative computer system of the invention includes a first computing device and an interface device. The first computing device incorporates an adapter that includes a connector and a first protrusion. The interface device incorporates an interface connector and an interface adapter. The interface connector is configured to mate with the connector of the first computing device. The interface adapter defines a first alignment surface that is configured to engage the first protrusion of the first computing device as the interface connector is moved toward mating engagement with the connector of the first computing device. This enables the interface connector to be aligned with the connector of the first computing device prior to engagement.

Other features and advantages of the present invention will become apparent to one with skill in the art upon examination of the following drawings and detailed description. It is intended that all such features and advantages be included herein within the scope of the present invention, as defined in the appended claims.

BRIEF DESCRIPTION OF THE SEVERAL VIEWS OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION

As described in greater detail herein, the present invention involves the use of interface devices that are configured to facilitate intercommunication of computing devices. Preferably, such an interface device can be conveniently, matingly engaged with an associated computing device without damaging components of either the interface device or the computing device to which it is being connected. In some embodiments, this is accomplished by providing one or more alignment members of the interface device, each of which is adapted to engage a corresponding alignment feature of the computing device. By engaging the alignment feature(s) with the alignment member(s), a user of such an interface device can properly align the corresponding connectors of the interface device and the computing device. Thus, the present invention can potentially eliminate damage to components of interface devices and/or computing devices typically caused during installation of an interface device by ensuring proper alignment of the connectors of such devices prior to physical engagement of the connectors.

Figure 1:
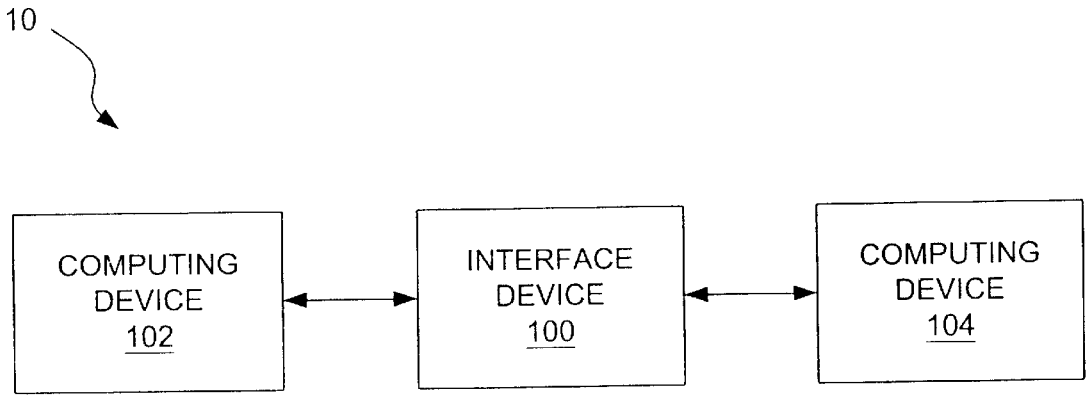
FIG. 1 is a schematic diagram depicting a representative embodiment of a computer system of the present invention.

Referring now to the figures, wherein like reference numerals indicate corresponding components throughout the several views, FIG. 1 depicts a representative embodiment of a computer system 10 of the invention. As shown in FIG. 1, computer system 10 includes an interface device 100 that is used to communicatively couple a first computing device 102 with a second computing device 104. By way of example, computing device 102 can be a personal computer and computing device 104 can be a printer or multi-function device. As used herein, the term "multi-function device" refers to a computing device that is capable of performing more than one of copying, faxing, scanning and printing. Note, in FIG. 1, a single interface device is used to interconnect two computing devices. In other embodiments, various other numbers of interface devices and/or computing devices can be used.

Figure 2:
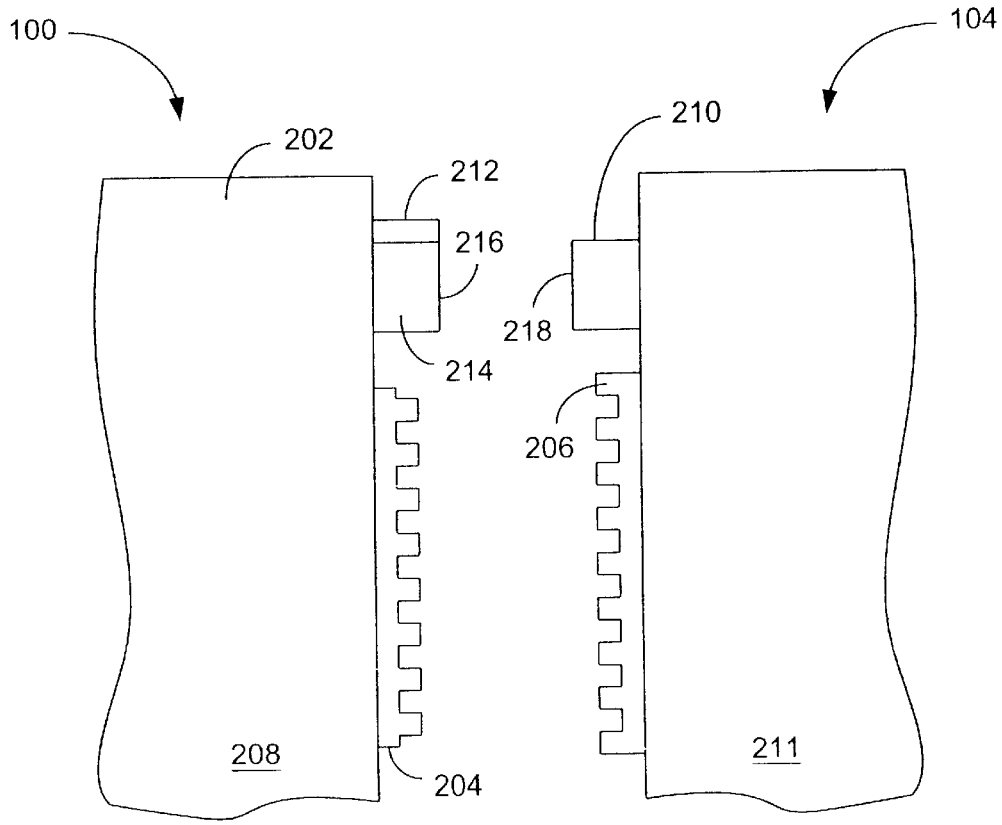
FIG. 2 is a schematic diagram depicting a portion of a representative embodiment of the interface device of FIG. 1, with the interface device positioned adjacent to a representative embodiment of an adapter to which the interface device can be mounted.

A schematic diagram depicting a portion of a representative interface device 100 and a corresponding portion of a representative computing device 104 is shown in FIG. 2. In FIG. 2, interface device 100 includes an interface adapter 202 and a interface communication connector 204. Connector 204 is adapted to communicatively couple with connector 206 of computing device 104. Interface adapter 202 includes a body 208 that encases at least a portion of connector 204. The body is configured for a user to grasp, such as when the connectors are being communicatively coupled to each other.

As shown in FIG. 2, a protrusion 210 extends outwardly from computing device 104. In some embodiments, the protrusion is a nut that is used to secure connector 206 of the computing device to the chassis or housing 211 of the computing device. An alignment member 212 of interface adapter 202 is adapted and arranged to engage the protrusion. In particular, the alignment member includes an alignment surface 214 that is positioned to engage at least a portion of the protrusion.

Preferably, as the interface adapter of the interface device is moved toward the connector of the computing device, the distal end 216 of the alignment member can engage the distal end 218 of the protrusion. Preferably, engagement of the aforementioned distal ends substantially prevents the connectors of the interface device and computing device from engaging each other until they are properly aligned with each other. Typically, the connector of the interface adapter is configured so that it does not extend beyond the distal end of the alignment member(s). So configured, if a user attempts to connect the interface adapter with the adapter of the computing device, and the connectors are not properly aligned, the connector of the interface adapter does not contact the computing device.

In FIG. 2, the connector of the interface device is configured as a male connector and the connector of the computing device is configured as a female connector. However, the connectors could be configured with the male end associated with the computing device and the female end associated with the interface device.

The ability to communicatively couple an interface device easily with a computing device becomes increasingly important as the cost associated with replacing components damaged during installation of the interface device increases. Such can be the case when a component, such as printer formatter, is constructed as a portion of an interface device. Conventionally, printer formatters have been provided as internal components of computing devices, e.g., personal computers. These printer formatters enable the computing device with which they are associated to provide information to an another computing device, e.g., a printer or multi-function device, in a format that can be readily used. Recently, however, interface devices, such as printer cables, have been provided with printer formatters. This enables a personal computer, for example, to be constructed without a printer formatter.

Using a relatively expensive interface device, such an interface device that includes a printer formatter, can be problematic. In particular, if a user damages a portion of the connector of the interface device, such as by bending a pin, the entire interface device may require replacing. A representative embodiment of an interface device that potentially alleviates this concern is depicted in FIG. 3.

Figure 3:
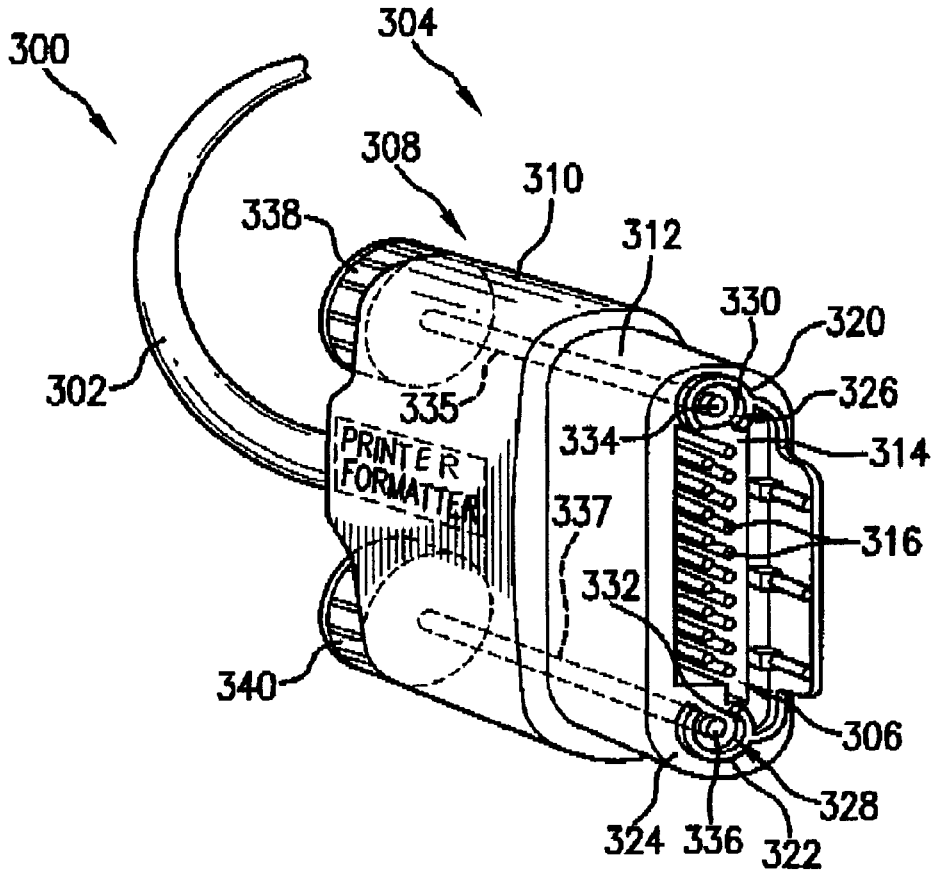
FIG. 3 is a cut-away, perspective view of a representative embodiment of the interface device of FIGS. 1 and 2.

In FIG. 3, interface device 300 includes a communication medium 302 with a first interface adapter 304 arranged at one of its ends and a second interface adapter (not shown) arranged at the other of its ends (also not shown). Note, in some embodiments, the first and second interface adapters may be configured differently from each other. Interface adapter 304 at least partially houses an interface communication connector 306 that is adapted to communicatively couple with a connector of a computing device. In some embodiments, communication connector 306 can be relatively robust connector, such as a DB25 connector, although various other types of connectors can be used.

Body 308 includes a first portion 310 and a second portion 312. The second portion defines an opening 314 which provides access to connector 306. In some embodiments, such as depicted in FIG. 3, at least a portion of the connector protrudes through the opening from an interior of the interface adapter. In particular (since connector 306 of FIG. 3 is configured as a male connector), pins 316 can protrude through the opening.

First and second alignment members 320 and 322, respectively, extend from end 324 of the interface adapter. Each of the alignment members defines a cavity (326, 328) that is sized and shaped to receive at least a portion of a corresponding protrusion of a computing device. In FIG. 3, each cavity is bounded at least partially by an alignment surface (330, 332) that is adapted to engage an exterior surface of a corresponding protrusion. Typically, an alignment member is arranged adjacent to each end of the connector.

As shown in FIG. 3, body 308 mounts fasteners (334, 336) that are adapted to secure the interface adapter to a corresponding adapter of a computing device. In particular, the fasteners include an externally threaded shafts (335, 337), each of which can protrude into a corresponding cavity (326, 328). Each shaft can be rotated by turning an associated base (see 338, 340 of FIG. 4) which is arranged adjacent to an end 342 of the first portion of the body. Preferably, each base is received within a corresponding recess (344, 346) formed in end 342.

Additionally, the interface adapter can include a protruding segment that is adapted to be received within a corresponding slot formed in the computing device to which the interface device is to be connected. By way of example, the embodiment of FIG. 4 includes a protruding segment 350 that is sized and shaped to be received within slot 352. The protruding segment can prevent a user from connecting the interface device to a computing device that does not incorporate a corresponding slot. Typically, a computing device configured as a personal computer does not include such a slot, in which case, the connector of the interface device should be prevented from contacting the connector of the personal computer. This can prevent damage to the connectors as well as other components of the interface device, e.g., a printer formatter.

Figure 4:
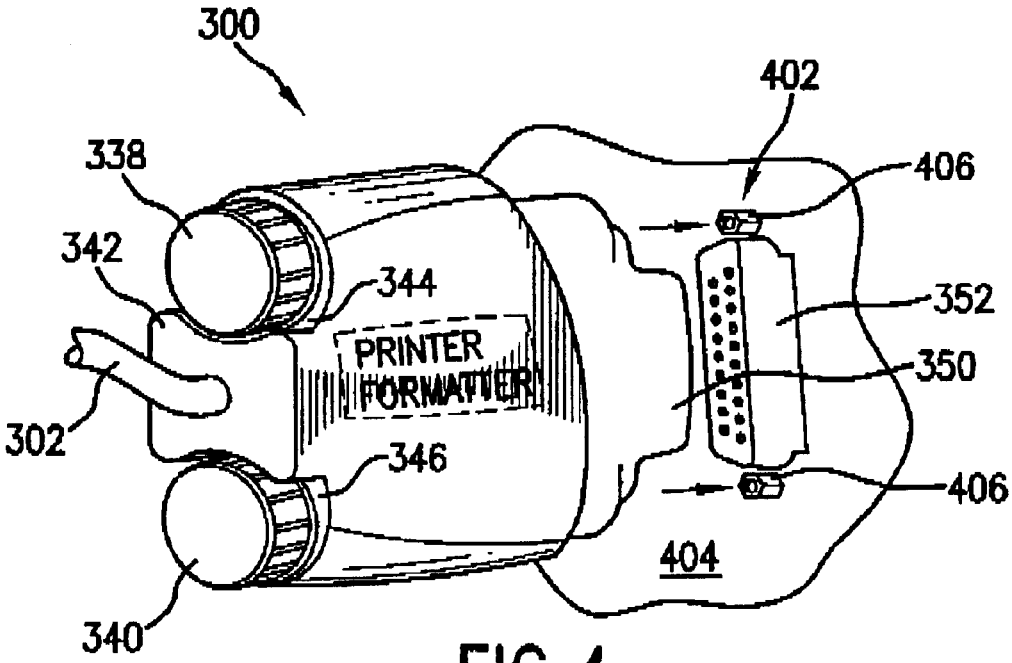
FIG. 4 is a cut-away, perspective view of the embodiment of the interface device of FIG. 3, with the interface device positioned adjacent to a representative embodiment of an adapter to which the interface device can be mounted.

By moving the interface adapter toward the adapter 402 of a computing device 404 (such as depicted by arrows in FIG. 4), each of the alignment members can be positioned to engage a corresponding protrusion 406 of the computing device. In FIG. 4, each protrusion is configured as a nut. So configured, once the alignment members are appropriately aligned with the nuts, the base of each fastener can be rotated so that the threaded shafts of the fasteners engage corresponding internal threads of the nuts. Continued rotation of the fasteners then draws the interface adapter closer to the adapter until the connectors of the adapter communicatively couple.

Figure 5:
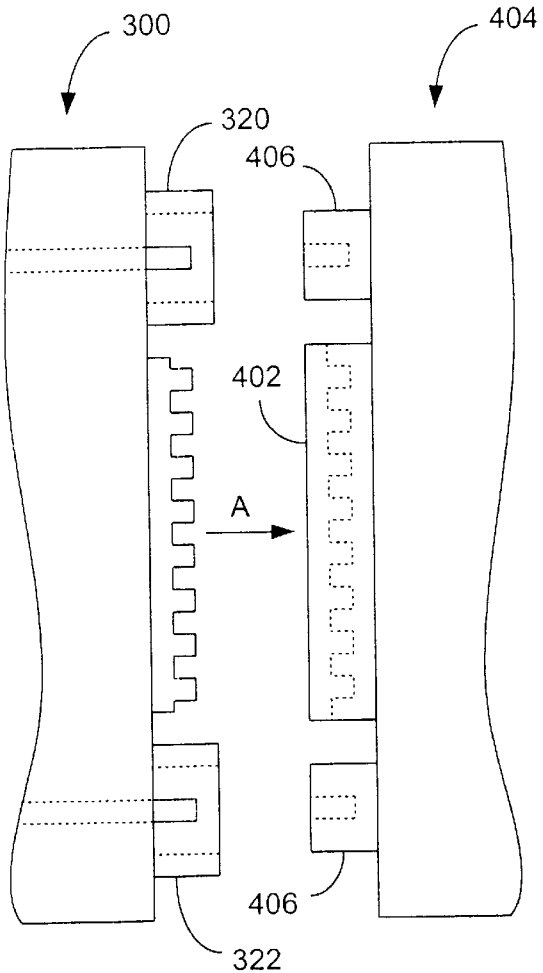
FIG. 5 is a schematic diagram depicting a portion of a representative embodiment of the interface device of FIG. 1, with the interface device positioned adjacent to a representative embodiment of an adapter to which the interface device is being mounted.

Operation of the interface device of FIGS. 3 and 4 will now be described with reference to the schematic diagrams of FIGS. 5–7. As shown in FIG. 5, interface device 300 is moved toward adapter 402 of computing device 404, such as by moving the interface adapter in direction A. Movement of the interface device toward the adapter can be temporarily discontinued as one or more of the alignment members (320, 322) engages the computing device. For instance, the interface adapter and the adapter of the computing device could engage each with the alignment members nearly simultaneously engaging a corresponding protrusion 406. Clearly, however, only one of the alignment members could engage the computing device, e.g., at a location other than a protrusion, to alert a user to discontinue and/or cautiously continue movement in direction A.

Figure 6:
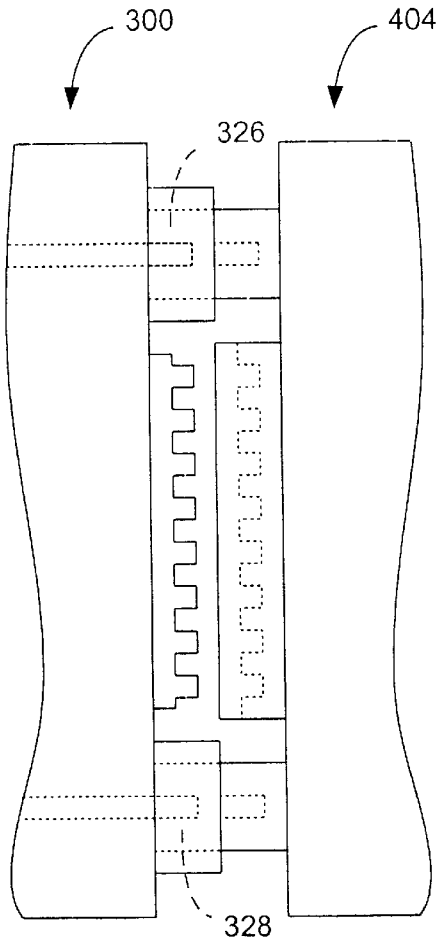
FIG. 6 is a schematic diagram depicting the interface device of FIG. 5, with the alignment members of the interface device engaging the alignment protrusions of the adapter.

In FIG. 6, the alignment members are positioned to engage the protrusions. In particular, each alignment member is aligned to receive a corresponding protrusion within its respective cavity (326, 328). This can be accomplished by engaging an exterior surface of each protrusion with an alignment surface of each alignment member. Once so positioned, the connector of the interface adapter preferably is aligned with the connector of adapter.

Figure 7:
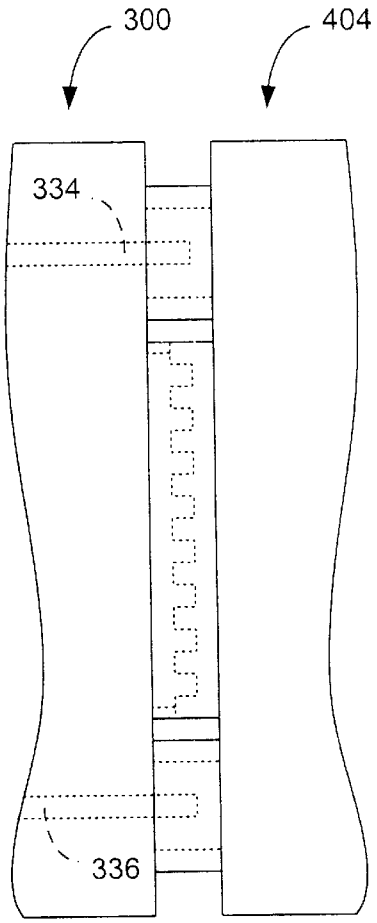
FIG. 7 is a schematic diagram depicting the interface device of FIG. 5, with the connector of the interface device communicatively coupled to the connector of the adapter.

Continued movement of the interface adapter toward the adapter of computing device enables the connectors to communicatively couple, as depicted in FIG. 7. As shown in FIG. 7, fasteners (334, 336) of the interface adapter engage the protrusions for securing the connectors together. More specifically, the protrusions can be nuts that are used to attach the adapter to the computing device. Preferably, the fasteners engage the internal threads of the nuts. Note, threaded engagement of the fasteners and nuts can be used to draw the interface adapter and the adapter close enough to each other to communicatively couple the connectors.

Based on the foregoing, it should be appreciated that embodiments of the present invention can potentially eliminate damage to components of interface devices and/or computing devices typically caused during installation of an interface device. This preferably is accomplished by providing an interface adapter and an associated connector that are configured to ensure proper alignment of the connectors of the devices is achieved prior to enabling the connectors of the devices to physically engage each other.

The foregoing description has been presented for purposes of illustration and description. It is not intended to be exhaustive or to limit the invention to the precise forms disclosed. Modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated.

For instance, the embodiments of the invention shown herein depict connectors of the interface devices in a particular arrangement relative to their associated alignment members. In particular, the alignment members are depicted as extending farther from the ends of the interface adapters than the connectors. It should be noted, however, that in some embodiments, the connectors and/or alignment members may not extend from the ends of their respective interface adapters. Preferably, regardless of the particular configuration, one or more of the alignment members of an interface device should be capable of engaging a corresponding component of a computing device prior to the connector of the interface device engaging the computing device. All such modifications and variations, are within the scope of the invention as determined by the appended claims when interpreted in accordance with the breadth to which they are fairly and legally entitled.

What is claimed is:

1. A computer system comprising:

a first computing device having an adapter, said adapter including a communication connector and a first protrusion; and an interface device having an interface communication connector and an interface adapter, said interface communication connector configured to mate with said communication connector of said first computing device, said interface adapter engaging said interface communication connector and including a printer formatter, said printer formatter being communicatively coupled to said interface communication connector, said printer formatter being configured to receive data, convert the data to a format corresponding to the first computing device, and provide the data converted to said interface communication connector, said interface adapter defining a first alignment surface, said first alignment surface being configured to engage said first protrusion of said first computing device as said interface communication connector is moved toward mating engagement with said communication connector of said first computing device such that said interface communication connector can be aligned with said communication connector of said first computing device prior to engagement with said communication connector, wherein said first computing device is a printer configured to receive the data converted from said interface communications connector and print the data to hard copy, said first computing device lacking a printer formatter.

2. The communication interface device of claim 1, further comprising:

a second computing device communicatively coupled to said first computing device via said interface device.

3. The communication interface device of claim 1, wherein said first computing device has a second protrusion, and wherein said interface adapter includes a second alignment surface adapted to engage said second protrusion, said interface communication connector being arranged between said first alignment surface and said second alignment surface such that engagement of said first alignment surface with said first protrusion and said second alignment surface with said second protrusion aligns said interface communication connector with said communication connector of said first computing device.

4. The computer system of claim 3, wherein said interface adapter includes a body portion, a first alignment member and a second alignment member, said first and second alignment members extending outwardly from said body portion; and wherein said first alignment surface is defined by said first alignment member and said second alignment surface is defined by said second alignment member.

5. The computer system of claim 4, wherein said body portion has an end, said first alignment member and said second alignment member extending farther from said end than said interface communication connector.

6. A communication interface device for use in a computer system, the computer system including a first computing device and a second computing device, the first computing device having a first communication connector, the second computing device having a second communication connector and a protrusion extending outwardly therefrom, said interface device comprising:

a first interface communication connector configured to couple communicatively with the first communication connector of the first computing device;

a communication medium having a first end and a second end, said first end communicatively coupled to said first interface communication connector; and an interface adapter having a body portion, a printer formatter housed by said body portion, and a second interface communication connector, said second interface communication connector being communicatively coupled to said second end of said communication medium, said printer formatter being communicatively coupled to said second interface communication connector, said printer formatter being configured to receive data, convert the data to a format corresponding to the second computing device, and provide the data converted to said second interface communication connector, said body portion having a first alignment member extending outwardly therefrom, said first alignment member having a distal end located such that, when said second interface communication connector is moved toward mating engagement with the second communication connector of the second computer, said distal end of said first alignment member engages the protrusion prior to said second interface communication connector engaging the second communication connector of the second computer.

* * * * *